US005618404A

United States Patent [19]

Okuhama et al.

[11] Patent Number: 5,618,404

[45] Date of Patent: Apr. 8, 1997

[54] ELECTROLYTIC PROCESS FOR PRODUCING LEAD SULFONATE AND TIN SULFONATE FOR SOLDER PLATING USE

[75] Inventors: Yoshiaki Okuhama; Seishi Masaki; Takao Takeuchi, all of Kobe; Yoshiharu Matsuda, Ube; Masakazu Yoshimoto, Kobe, all of Japan

[73] Assignee: Daiwa Fine Chemicals Co., Ltd., Hyogo-ken, Japan

[21] Appl. No.: 442,535

[22] Filed: May 16, 1995

[30] Foreign Application Priority Data

May 17, 1994 [JP] Japan ..... 6-125880

[51] Int. Cl.[6] ..... C25B 1/00

[52] U.S. Cl. ..... 205/445; 205/457; 205/458

[58] Field of Search ..... 205/445, 458, 205/457, 254, 348, 497, 494, 299, 50; 252/518

[56] References Cited

U.S. PATENT DOCUMENTS 4,985,127 1/1991 Vaughan .

FOREIGN PATENT DOCUMENTS 62-146289 6/1987 Japan .
64-62488 3/1989 Japan .

*Primary Examiner*—Kathryn Gorgos
*Assistant Examiner*—Brendan Mee
*Attorney, Agent, or Firm*—Panitch Schwarze Jacobs & Nadel, P.C.

[57] ABSTRACT

An electrolytic process for producing lead and tin sulfonates which comprises applying a DC voltage to an anode and a plurality of cathodes in an electrolytic cell and thereby dissolving lead or tin in an electrolytic solution. The electrolytic cell is partitioned by cation- and anion-exchange membranes into anode and cathode chambers. The electrolytic solution is a solution of an organic sulfonic acid, and the anode is lead or tin. The process reduces contents of radioisotopes such as uranium and thorium to a level of less than 50 ppb, and therefore the coatings formed by solder plating using the lead and tin salts in accordance with the invention show radioactive α particle counts of less than 0.1 CPH/cm$^2$.

3 Claims, 1 Drawing Sheet

ELECTROLYTIC PROCESS FOR PRODUCING LEAD SULFONATE AND TIN SULFONATE FOR SOLDER PLATING USE

BACKGROUND OF THE INVENTION

This invention relates to an electrolytic process for producing lead and tin sulfonates for use in solder plating to form coatings with smaller counts of radioactive α particles than heretofore; plating baths containing those lead and tin salts having a reduced content of radioactive isotope impurities such as uranium and thorium; and electrodeposits formed by solder plating whose radioactive α particle counts are less than 0.1 CPH/cm$^2$.

A new aspect of the highly developed electronic industry today is the use of tinning or solder plating in precoating electronic components to enhance their solderability. Formerly borofluoride baths were used for solder plating. They have largely been supplanted by less toxic baths of organic sulfonates as an antipollution measure. Fluorine, one of the elements constituting borofluoric acid for the former baths, is highly toxic and involves difficulties in the wastewater disposal. Many reports have thus far been made on the plating techniques using those organic sulfonates and also about the additives for them.

The organic lead and tin sulfonates to be employed in solder plating solutions are usually prepared by heating and dissolving the oxide, hydroxide, or carbonate of such a metal in an organic sulfonic acid. The oxides, hydroxides, and carbonates of those metals contain much uranium (U) and thorium (Th), both of which are alpha-ray sources. Thus the greatest disadvantage of the ordinary chemical dissolving process stems from the contamination of the lead and tin sulfonates with the impurities; the electrodeposits formed by solder plating with those salts produce α rays abundantly enough to invite soft errors of memory devices.

We have already filed a patent application (Kokoku No. 4624/1991) for an electrolytic process for producing organic lead and tin sulfonates, etc. using anion-exchange membranes, with 99.99%-pure metallic lead and tin as anodes. Metallic lead and tin as such contain uranium and thorium, both α-ray sources. Therefore, although the patent process gives solder plating electrodeposits of somewhat smaller counts of radio-active α particles than the conventional chemical dissolving method, a further improvement in the process is required for greater reliability of memory devices.

In view of these, the present invention aims at providing an electrolytic process for producing organic lead and tin sulfonates with reduced counts of radioactive α particles through removal of the radioactive isotopes, such as uranium and thorium, inevitably contained as impurities in lead and tin that are chief components of the coatings formed by solder plating, in order to realize solder plating with fewer occurrences of semiconductor memory errors than heretofore.

SUMMARY OF THE INVENTION

The invention resides in an electrolytic process for producing a lead sulfonate or tin sulfonate having a reduced content of radioactive isotope impurities such as uranium and thorium which comprises applying a DC voltage to an anode made of lead or tin and a plurality of cathodes in an electrolytic cell and thereby dissolving lead or tin in an electrolytic solution, said electrolytic cell being partitioned by cation-and anion-exchange membranes into anode and cathode chambers, said electrolytic solution being a solution of an organic sulfonic acid selected from the group consisting of aliphatic sulfonic acids of the formula (I)

$$(X_1)_n—R—SO_3H \quad (I)$$

in which R is a $C_1$~$C_5$ alkyl group and $X_1$ is a hydroxyl, alkyl, aryl, alkylaryl, carboxyl, or sulfonic acid group which may be situated in any position relative to the alkyl group, n being an integer of 0 to 3, and aromatic sulfonic acids of the formula (II)

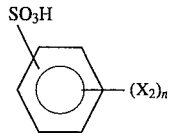

(II)

in which $X_2$ is a hydroxyl, alkyl, aryl, alkylaryl, aldehyde, carboxyl, nitro, mercapto, sulfonic acid, or amino group, or two $X_2$ may combine with a benzene ring to form the rings of naphthalene, m being an integer of 0 to 3.

Additional subject matters of the present invention are the organic lead and tin sulfonates obtained by the above manufacturing process and whose contents of radioactive isotope impurities such as uranium and thorium are reduced to less than 50pp b, solder plating baths comprising the solutions of these organic lead and tin sulfonates, and electrodeposits formed by solder plating from such plating baths and whose countes of radioactive α particles are less than 0.1 CPH/cm$^2$.

DESCRIPTION OF THE PREFERRED EMBODIMENT

Figure 1:
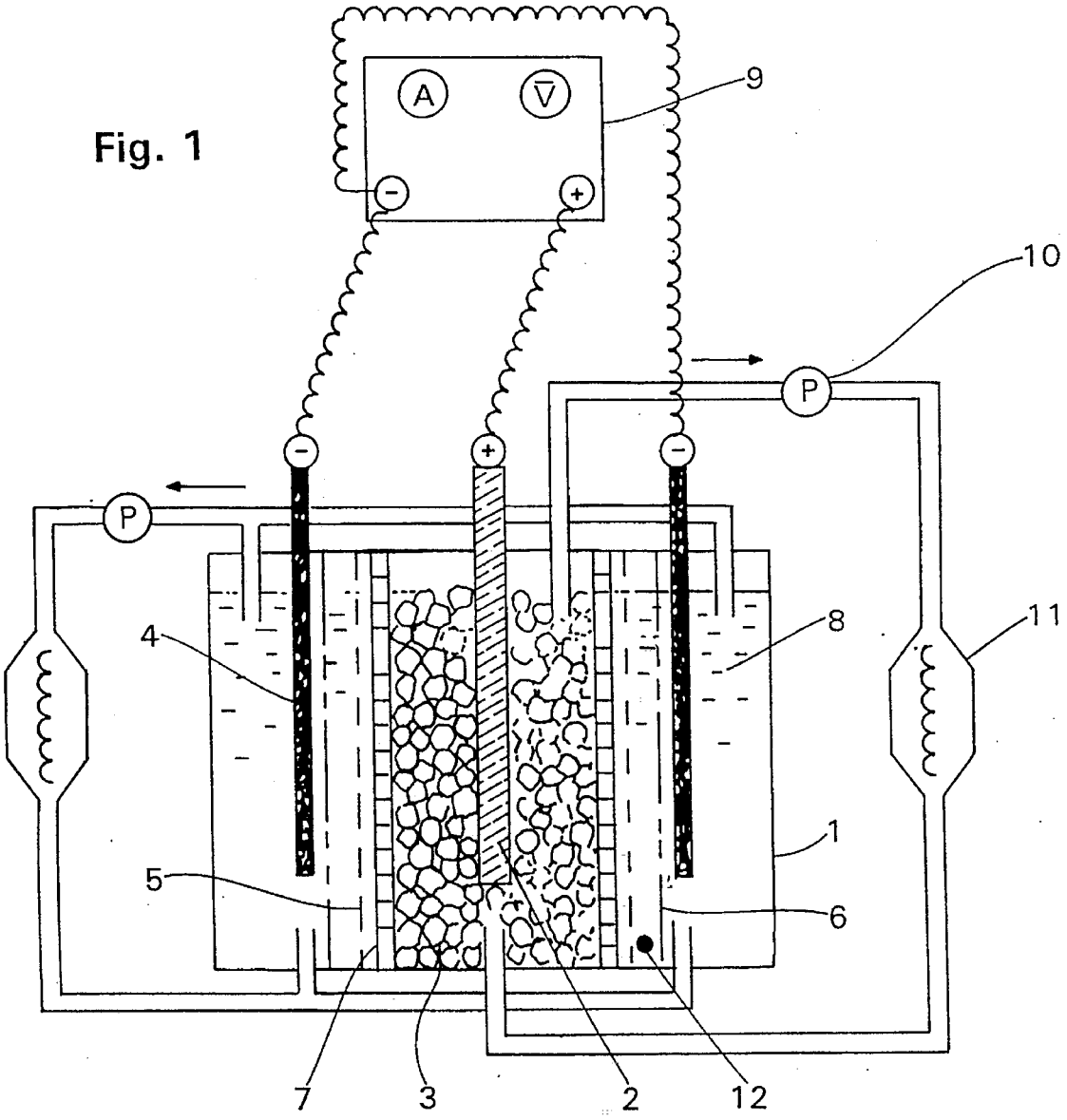
FIG. 1 is a vertically sectional schematic view of an electrolytic apparatus useful for the process of the invention.

A typical apparatus for electrolysis that may be used in carrying out the electrolytic process of the invention is illustrated in FIG. 1 of the accompanying drawing. Referring to FIG. 1, there is shown an electrolytic cell 1 for producing lead sulfonate or tin sulfonate, as including two cathodes 4, e.g., of platinum plate, and one anode 2, e.g., of a lead or tin rod, disposed between the cathodes, the anode being surrounded by a pack of granular lead or tin 3 to be dissolved. Cation-exchange membranes 5 and anion-exchange membranes 6 are arranged, one each, between the anode 2 and each of the cathodes 4 to complete an electrolytic cell of multilayer structure. Further, between the anode 2 and each cathode 4 is located a shielding plate 7 to define an anode chamber and a cathode chamber. The anode and cathode chambers thus formed are filled with an electrolytic solution 8 consisting of an organic sulfonic acid solution. The solution is stirred and cooled by circulating pumps, e.g., chemical pumps 10, and heat exchangers 11. a DC power supply 9 is connected to both the anode and cathodes. The solution of organic lead sulfonate or tin sulfonate that has resulted from electrolysis is taken out through a product outlet 12.

The conditions for electrolysis according to the present invention are as follows. The density of the current that passes through the membranes is 1~50 A/dm$^2$, preferably 5~30 A/dm$^2$, the electrolytic solution temperature is 10°~50° C., preferably 20°~40° C., and the electrode voltage is 0.5~20 V, preferably 1~5 V. These electrolysis conditions and operation procedure may optionally be modified so as to obtain an organic lead or tin sulfonate which will give solder plated films with radioactive α particle counts of 0.1 CPH/cm$^2$ or less.

The electrolytic solution to be used in the present invention is a solution of an organic sulfonic acid selected from the group consisting of aliphatic sulfonic acids of the formula (I)

$$(X_1)_n—R—SO_3H \quad (I)$$

in which R is a $C_1$~$C_5$ alkyl group and $X_1$ is a hydroxyl, alkyl, aryl, alkylaryl, carboxyl, or sulfonic acid group which may be situated in any position relative to the alkyl group, n being an integer of 0 to 3, and aromatic sulfonic acids of the formula (II)

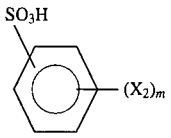

(II)

in which $X_2$ is a hydroxyl, alkyl, aryl, alkylaryl, aldehyde, carboxyl, nitro, mercapto, sulfonic acid, or amino group, or two $X_2$ may combine with a benzene ring to form the rings of naphthalene, m being an integer of 0 to 3. The concentration of the organic sulfonic acid in the electrolytic solution may suitably be chosen depending on the intended sulfonate concentration. Usually, the sulfonic acid concentration is 5~50%, preferably 25~40%.

Examples of the organic sulfonic acid are methanesulfonic, ethanesulfonic, propanesulfonic, 2-propanesulfonic, butane-sulfonic, 2-butanesulfonic, pentanesulfonic, 2-hydroxyethane-1-sulfonic, 2-hydroxypropane-1-sulfonic, 2-hydroxybutane-1-sulfonic, 2-hydroxypentanesulfonic, 1-carboxyethanesulfonic, 1,3-propanedisulfonic, arylsulfonic, 2-sulfoacetic, 2- or 3-sulfopropionic, sulfosuccinic, sulfomaleic, sulfofumaric, benzenesulfonic, toluenesulfonic, xylenesulfonic, nitro benzenesulfonic, sulfobenzoic, sulfosalicylic, benzaldehydesulfonic, p-phenolsulfonic, and phenol-2,4-disulfonic acids.

These sulfonic acids may be used singly or as a mixture of two or more.

The lead or tin to be employed as the anode desirably has a purity of at least 99.9%, and although it may take any shape, a granular or globular one is desirable. The cathode material is preferably inert to the electrolytic solution. A suitable material, e.g., is a sheet of platinum, nickel, titanium, stainless steel, carbon, or titanium plated with platinum.

The cation- and anion-exchange membranes basically should have small electric resistance and good resistance to acids, wear, and heat. Moreover, the cation-exchange membrane must allow the lead or tin cations that have dissolved out of the anode to pass, and the anion-exchange membrane must act to deter the migration of the lead or tin cations into the cathode. Useful exchange membranes for these purposes include the products of Tokuyama Soda Co., marketed under the trade designations of "CMS" and "C66-10F" (cation-exchange membranes) and "ACLE-5P" and "AM-2" (anion-exchange membranes).

While the reduction of the radioactive α particle count under the invention should not be explained yet in connection with any specific theory, it is presumably attributable to the following phenomena. The lead or tin cations that have dissolved out of the anode remain as they are in the electrolytic solution, while uranium and thorium dissolve into the solution to form cation complexes. The latter thus do not pass through the cation-exchange membranes whereas the lead and tin ions and also hydrogen ions do pass. On the other hand, the anion-exchange membranes prevent the lead or tin ions from migrating into the cathodes. The result is that a lead or tin sulfonate solution, freed from uranium and thorium, is continuously taken out from between the cation and anion-exchange membranes.

The organic lead or tin sulfonate that results from the electrolytic process of the invention is in the form of a solution of the lead salt or tin salt dissolved in the electrolytic solution. The resulting solution therefore contains free sulfonic acid too. Usually, the solution of the lead salt is an aqueous solution containing 5~25% by weight, preferably 10~15% by weight, as $Pb^{2+}$, of the lead sulfonate and 5~30% by weight, preferably 10~20% by weight, of free sulfonic acid. In the case of the tin salt, it is an aqueous solution containing 5~25% by weight, preferably 10~15% by weight, as $Sn^{2+}$, of the tin sulfonate and 5~30% by weight, preferably 10~20% by weight, of free sulfonic acid. The aqueous solution thus obtained can be directly used in solder plating, but it is common that the lead or tin concentration and the free sulfonic acid concentration are adjusted before use so as to perform solder plating as desired.

The organic lead or tin sulfonate solution according to the present invention may be used in the usual manner for sulfonic acid-bath solder plating.

For example, the solder plating bath has the following composition:

organic lead sulfonate (as $Pb^{2+}$) =0.1~80 g/l, preferably 0.5~60 g/l; or organic tin sulfonate (as $Sn^{2+}$) =0.1~80 g/l, preferably 0.5~60 g/l; and free sulfonic acid =50~200 g/l, preferably 100~150 g/l.

The plating bath may contain well-known additives, such as a surface active agent.

As for the plating conditions, the current density is 0.2~50 A/dm$^2$, preferably 1~15 A/dm$^2$, and the temperature is 5°~30° C., preferably 15°~25° C.

The use of the organic lead or tin sulfonate produced by the electrolytic process of the invention in solder plating permits a decrease in the count of the radioactive α particles in the coating to less than 0.1 CPH/cm$^2$. This is realized because, as noted above, the electrolytic process of the invention reduces the contents of the uranium and thorium that are both contained as inevitable impurities in the lead or tin, the chief ingredient of the solder plated coating, to a level of less than 50 ppb.

EXAMPLES

The present invention is illustrated by the following examples, which are not limitative. It is to be understood that various modifications may be made within the scope of the invention directed to the obtainment of the organic lead and tin sulfonates that will give plated coatings with radioactive α particle counts of 0.1 or less CPH/cm$^2$.

Examples of electrolytic manufacture of organic sulfonates

Production Example 1

This example illustrates the manufacture of lead methanesulfonate using an electrolytic apparatus shown in FIG. 1.

The electrolytic cell was built of acrylic plate 5 mm thick. It comprised two cation-exchange membranes ("C66-10F") measuring 5×18=90 cm$^2$, two anion-exchange membranes ("ACLE-5P") of the same size, and two shielding membranes with 2.5 mm~ dia. perforations made in a mesh-like pattern at a pitch of 2.5 mm, all the membranes being set in position to define an anode chamber of 250 ml capacity, two 100-ml product chambers, and two 324-ml cathode chambers. In the center of the anode chamber was placed a lead rod of 99.9% purity for contact use, and the space around the rod was packed with granular lead, also of 99.9% purity. Two pieces of titanium sheet, 0.9 $dm^2$ each, were used as cathodes. The anode and cathode chambers were filled with solutions of methanesulfonic acid at predetermined concentrations. Electrolysis was carried out applying a DC voltage to the anode and cathodes with simultaneous circulation and cooling of the anolyte at a flow velocity of 3.3l/min and of the catholyte at a velocity of 2.2l/min.

The results obtained, together with the conditions for electrolysis, the concentrations of free acid (FA) in the solutions of the product chamber and cathode chamber before electrolysis, the concentrations of FA and $Pb^{2+}$ions in the solutions of the product chamber and cathode chamber after electrolysis, the concentration of uranium (U) and trium (Th) in the solution of the product chamber after electrolysis and Pb dissolution efficiency, are summarized in Table 1.

TABLE 1

| Conditions for electrolysis | | Solution before electrolysis | | Solution after electrolysis | | Pb dissolution efficiency |
|---|---|---|---|---|---|---|
| | | Product chamber | Cathode | Product chamber | Cathode | |
| Constant-current electrolysis | 10.7 Ahr | FA 30.2% | FA 20.5% | FA 19.7% | FA 19.4% | 112.5% |
| Membrane current density | 5 $A/dm^2$ | | | $Pb^{2+}$ 10.3% | $Pb^{2+}$ 0.0% | |
| Mean solution temperature | 40° C. | | | | | |
| Mean electrode voltage | 1.43 V | | | | | |
| | | | | U 27.4 ppb | | |
| | | | | Th 18.3 ppb | | |

*FA stands for free acid.

For comparison, electrolysis of lead was conducted in the same manner as described in production Example 1 using a methanesulfonic acid solution with the exception that only two anion-exchange membranes ("ACLE-P") are used in the electroytic cell, without using two cation exchange membranes.

The results obtained summarized in Table 1-1.

TABLE 1-1

| Conditions for electrolysis | | Solution before electrolysis | | Solution after electrolysis | | Pb dissolution efficiency |
|---|---|---|---|---|---|---|
| | | Product chamber | Cathode | Product chamber | Cathode | |
| Constant-current electrolysis | 10.5 Ahr | FA* 31.0% | FA 20.4% | FA 19.5% | FA 19.2% | 110.7% |
| Membrane current density | 5 $A/dm^2$ | | | $Pb^{2+}$ 10.1% | $Pb^{2+}$ 0.0% | |
| Mean solution temperature | 35° C. | | | | | |
| Mean electrode voltage | 1.20 V | | | | | |
| | | | | U 89.7 ppb | | |
| | | | | Th 170.5 ppb | | |

Production Example 2

This example illustrates the manufacture of tin methanesulfonate.

The construction of the electrolytic cell used was the same as that of Production Example 1. Electrolysis was conducted in the manner described above with the exception that a 99.9%-pure tin rod for contact use was placed in the anode chamber and surrounded by a pack of granular tin, also with 99.9% purity. Table 2 shows the results.

TABLE 2

| Conditions for electrolysis | | Solution before electrolysis | | Solution after electrolysis | | Sn dissolution efficiency |
|---|---|---|---|---|---|---|
| | | Product chamber | Cathode | Product chamber | Cathode | |
| Constant-current electrolysis | 23.3 Ahr | FA 40.1% | FA 20.5% | FA 19.5% | FA 19.3% | 96.7% |
| Membrane current density | 10 A/dm$^2$ | | | $Sn^{2+}$ 11.1% | $Sn^{2+}$ 0.0% | |
| Mean solution temperature | 34° C. | | | | | |
| Mean electrode voltage | 3.0 V | | | | | |
| | | | | U 8.5 ppb | | |
| | | | | Th 12.2 ppb | | |

For comparison, electrolysis of tin was conducted in the same manner as described in production Example 2 with the exception that only two anion-exchange membranes ("ACLE-5 P") are used in the electroytic cell, without using two cation-exchange membranes.

The results obtained summarized in Table 2-1.

For comparison, electrolysis of tin was conducted in the same manner as described in production Example 3 with the exception that only two anion-exchange membranes ("ACLE-5 P") are used in the electroytic cell, without using two cation-exchange membranes.

The results obtained summarized in Table 3-1.

TABLE 2-1

| Conditions for electrolysis | | Solution before electrolysis | | Solution after electrolysis | | Sn dissolution efficiency |
|---|---|---|---|---|---|---|
| | | Product chamber | Cathode | Product chamber | Cathode | |
| Constant-current electrolysis | 24.0 Ahr | FA 41.0% | FA 20.8% | FA 19.3% | FA 19.2% | 98.4% |
| Membrane current density | 10 A/dm$^2$ | | | $Sn^{2+}$ 10.8% | $Sn^{2+}$ 0.0% | |
| Mean solution temperature | 30° C. | | | | | |
| Mean electrode voltage | 2.8 V | | | | | |
| | | | | U 123.4 ppb | | |
| | | | | Th 158.1 ppb | | |

Production Example 3

This example illustrates the manufacture of tin 2-hydroxypropanesulfonate.

The electrolytic cell used was of the same construction as that of Production Example 1. Electrolysis was carried out in the same way with the exception that a 99.9%-pure tin rod for contact use was placed in the anode chamber and surrounded by a pack of 99.9%-pure granular tin and that a solution containing 2-hydroxypropanesulfonic acid was employed as the electrolytic solution. The results are given in Table 3.

TABLE 3

| Conditions for electrolysis | | Solution before electrolysis | | Solution after electrolysis | | Sn dissolution efficiency |
|---|---|---|---|---|---|---|
| | | Product chamber | Cathode | Product chamber | Cathode | |
| Constant-current electrolysis | 20.3 Ahr | FA 38.9% | FA 19.5% | FA 18.7% | FA 18.5% | 97.0% |
| Membrane current density | 10 A/dm$^2$ | | | $Sn^{2+}$ 10.0% | $Sn^{2+}$ 0.0% | |
| Mean solution temperature | 34° C. | | | | | |
| Mean electrode voltage | 3.0 V | | | | | |
| | | | | U 12 ppb | | |
| | | | | Th 16.3 ppb | | |

TABLE 3-1

| Conditions for electrolysis | | Solution before electrolysis: Product chamber | Solution before electrolysis: Cathode | Solution after electrolysis: Product chamber | Solution after electrolysis: Cathode | Sn dissolution efficiency |
|---|---|---|---|---|---|---|
| Constant-current electrolysis | 20 Ahr | FA 36.4% | FA 19.2% | FA 19.0% | FA 18.6% | 98.3% |
| Membrane current density | 10 A/dm$^2$ | | | $Sn^{2+}$ 10.3% | $Sn^{2+}$ 0.0% | |
| Mean solution temperature | 32° C. | | | | | |
| Mean electrode voltage | 2.3 V | | | | | |
| | | | | U 78.5 ppb | | |
| | | | | Th 121.0 ppb | | |

Further, electrolysis was performed in the same manner or described in production Example 3 using a lead rod for contact use and granular lead in place of the tin ones, and lead 2-hydroxypropanesulfonate was produced.

Production Example 4

This example illustrates the manufacture of lead p-phenolsulfonate.

Electrolysis was carried out using an electrolytic cell of the same construction as that of Production Example 1, with the exception that a solution containing p-phenolsulfonic acid was employed as the electrolytic solution. The results are shown in Table 4.

TABLE 4

| Conditions for electrolysis | | Solution before electrolysis: Product chamber | Solution before electrolysis: Cathode | Solution after electrolysis: Product chamber | Solution after electrolysis: Cathode | Pb dissolution efficiency |
|---|---|---|---|---|---|---|
| Constant-current electrolysis | 10.7 Ahr | FA 30.5% | FA 21.0% | FA 20.3% | FA 20.1% | 111.7% |
| Membrane current density | 5 A/dm$^2$ | | | $Pb^{2+}$ 10.8% | $Pb^{2+}$ 0.0% | |
| Mean solution temperature | 40° C. | | | | | |
| Mean electrode voltage | 1.43 V | | | | | |
| | | | | U 26.5 ppb | | |
| | | | | Th 21 ppb | | |

For comparison, electrolysis of lead was conducted in the same manner as described in production Example 4 with the exception that only two anion-exchange membranes ("ACLE-5 P") are used in the electroytic cell, without using two cation-exchange membranes.

The results obtained summarized in Table 4-1.

TABLE 4-1

| Conditions for electrolysis | | Solution before electrolysis: Product chamber | Solution before electrolysis: Cathode | Solution after electrolysis: Product chamber | Solution after electrolysis: Cathode | Pb dissolution efficiency |
|---|---|---|---|---|---|---|
| Constant-current electrolysis | 10.5 Ahr | FA 30.3% | FA 21.2% | FA 20.1% | FA 21.3% | 108.5% |
| Membrane current density | 5 A/dm$^2$ | | | $Pb^{2+}$ 10.5% | $Pb^{2+}$ 0.0% | |
| Mean solution temperature | 40° C. | | | | | |
| Mean electrode voltage | 1.2 V | | | | | |
| | | | | U 142.8 ppb | | |
| | | | | Th 212.6 ppb | | |

Further, in the same manner as described in Production Example 4 but replacing the lead rod for contact use and granular lead by tin ones, electrolysis was performed to obtain tin p-phenolsulfonate.

Examples of solder plating

The lead and tin sulfonates obtained in the preceding production examples were taken out of the product chambers of the electrolytic apparatus. They were dissolved in aqueous solutions of sulfonic acids, and a suitable surface active agent (e.g., polyoxyethylene laurylamine) was added to the solutions. Thus solder plating baths of the compositions shown in Table 5 were prepared. Using these baths, plating was performed with an insoluble anode of platinum-plated titanium and a cathode of copper sheet, both electrodes being connected to a DC source. The results are given, along with the plating bath compositions, plating conditions, compositions of the resulting electrodeposits, and counts of radioactive α particles, in Table 5.

TABLE 5

| Example No. | Plating bath composition | | | Current density (A/dm$^2$) | Time (min) | Electro-deposit composition Sn/Pb (%) | α particle count (CPH/cm$^2$) |
|---|---|---|---|---|---|---|---|
| 1 | Pb methanesulfonate | $Pb^{2+}$ | 19 g/l | 2 | 50 | 4.8/95.2 | 0.07 |
| | Sn methanesulfonate | $Sn^{2+}$ | 1 g/l | | | | |
| | Methanesulfonic acid | | 100 g/l | | | | |
| | Surface active agent | | 5 g/l | | | | |
| 2 | Pb p-phenolsulfonate | $Pb^{2+}$ | 38 g/l | 2.5 | 45 | 5.1/94.9 | 0.06 |
| | Sn p-phenolsulfonate | $Sn^{2+}$ | 2 g/l | | | | |
| | p-Phenolsulfonic acid | | 120 g/l | | | | |
| | Surface active agent | | 7 g/l | | | | |
| 3 | Pb 2-hydroxypropane-sulfonate | $Pb^{2+}$ | 8 g/l | 2 | 60 | 58.9/41.1 | 0.05 |
| | Sn 2-hydroxypropane-sulfonate | $Sn^{2+}$ | 12 g/l | | | | |
| | Methanesulfonic acid | | 100 g/l | | | | |
| | Surface active agent | | 5 g/l | | | | |
| 4 | Pb methanesulfonate | $Pb^{2+}$ | 57 g/l | 10 | 15 | 5.2/94.8 | 0.08 |
| | Sn methanesulfonate | $Sn^{2+}$ | 3 g/l | | | | |
| | Methanesulfonic acid | | 150 g/l | | | | |
| | Surface active agent | | 10 g/l | | | | |
| Comp. 1 | Pb methanesulfonate | $Pb^{2+}$ | 19 g/l | 2 | 60 | 4.5/95.5 | 0.54 |
| | Sn methanesulfonate | $Sn^{2+}$ | 1 g/l | | | | |
| | Methanesulfonic acid | | 100 g/l | | | | |
| | Surface active agent | | 5 g/l | | | | |
| Comp. 2 | Pb methanesulfonate | $Pb^{2+}$ | 19 g/l | 2 | 60 | 4.7/95.3 | 3.49 |
| | Sn methanesulfonate | $Sn^{2+}$ | 1 g/l | | | | |
| | Methanesulfonic acid | | 100 g/l | | | | |
| | Surface active agent | | 5 g/l | | | | |

In the above examples of solder plating, Comparative Example 1 represents solder plating conducted with a plating bath prepared from a lead methanesulfonate and tin methanesulfonate both produced by electrolysis in an electrolytic cell as described in Japanese Patent Application Kokoku No. 4624/1991, that used only a single anion-exchange membrane between an anode and a cathode.

Comparative Example 2 shows solder plating with a bath prepared from lead methanesulfonate and tin methanesulfonate both produced by dissolving lead oxide and tin oxide with heat in aqueous solutions of methanesulfonic acid.

It will be seen that the plating baths in the examples of the present invention gave electrodeposits with by far smaller counts of radioactive α particles than that in Comparative Example 1, although the count in the latter was restricted to some degree as compared with that in Comparative Example 2 where the plating solution was prepared from oxides.

The present invention thus renders it possible to form solder coatings capable of substantially suppressing the possibility of memory errors from a solder plating bath using organic lead and tin sulfonates, both produced by anodically dissolving metallic lead and tin having a purity of at least 99.9% each in an electrolytic cell partitioned by cation- and anion-exchange membranes into anode and cathode chambers. The solder plating according to this invention, therefore, is suitably applicable to the electronic components, such as 256 KB and larger capacity memories and VLSI semiconductor devices.

What is claimed is:

1. An electrolytic process for producing a lead sulfonate or tin sulfonate having a reduced content of radioactive isotope impurities including uranium and thorium, which comprises applying a DC voltage to an anode made of lead or tin and a plurality of cathodes in an electrolytic cell to dissolve lead or tin in the electrolytic solution, said electrolytic cell being partitioned by cation- and anion-exchange membranes into anode and cathode chambers, said electrolytic solution being a solution of an organic sulfonic acid selected from the group consisting of aliphatic sulfonic acids of the formula (I)

$$(X_1)_n—R—SO_3H \quad (I)$$

in which R is a $C_1$~$C_5$ alkyl group and $X_1$ is a hydroxyl, alkyl, aryl, alkylaryl, carboxyl, or sulfonic acid group which may be situated in any position relative to the alkyl group, n being an integer of 0 to 3, and aromatic sulfonic acids of the formula (II)

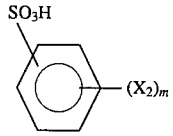

(II)

in which $X_2$ is a hydroxyl, alkyl, aryl, alkylaryl, aldehyde, carboxyl, nitro, mercapto sulfonic acid, or amino group, or two $X_2$ combine with a benzene ring to form the rings of naphthalene, m being an integer of 0 to 3.

2. The process according to claim 1 in which the anode is lead and a lead sulfonate is obtained.

3. The process according to claim 1 in which the anode is tin and a tin sulfonate is obtained.

* * * * *